US006835882B2

(12) United States Patent
Wilfer

(10) Patent No.: US 6,835,882 B2
(45) Date of Patent: Dec. 28, 2004

(54) CASE FOR MUSICAL INSTRUMENTS

(76) Inventor: Hans-Peter Wilfer, Zum Hackerhof 5, D-08258 Markneukirchen (DE)

( * ) Notice: Subject to any disclaimer, the term of this patent is extended or adjusted under 35 U.S.C. 154(b) by 0 days.

(21) Appl. No.: 10/453,825

(22) Filed: Jun. 3, 2003

(65) Prior Publication Data

US 2004/0118266 A1 Jun. 24, 2004

(30) Foreign Application Priority Data

Dec. 20, 2002 (EP) ..... 02028676

(51) Int. Cl.[7] ..... G10G 3/00
(52) U.S. Cl. ..... 84/453
(58) Field of Search ..... 84/453, 421, 329, 84/290

(56) References Cited

U.S. PATENT DOCUMENTS 4,000,678 A * 1/1977 Messina ..... 84/453
4,531,632 A 7/1985 Weber
6,563,036 B1 * 5/2003 Biasini ..... 84/453
2003/0015083 A1 * 7/2001 Godin et al.

FOREIGN PATENT DOCUMENTS

| | | |
|---|---|---|
| DE | 0114494 | 3/2002 |
| EP | 1111580 | 6/2001 |
| FR | 1593810 | 7/1970 |

* cited by examiner

*Primary Examiner*—Kimberly Lockett
(74) *Attorney, Agent, or Firm*—Sidley Austin Brown & Wood, LLP

(57) ABSTRACT

A case (11) for musical instruments, in particular for string instruments such as guitars, has a floor section (12) and a lid section (13) which are joined to one another by a hinge-like connection, in particular are sewn together, and can be closed by a fastening device (15), in particular a zipper. The case (11) further includes a positioning element (17) for positioning the musical instrument in the case (11) and a fixation device (22) with which the musical instrument is releasably fixed in the case by the positioning element (17). The positioning element (17) that is formed substantially as a pocket (25).

18 Claims, 6 Drawing Sheets

CASE FOR MUSICAL INSTRUMENTS

BACKGROUND OF THE INVENTION

1. Field of the Invention

The invention relates to a case for musical instruments, in particular for string instruments such as guitars, with

- a floor section and a lid section that are connected to one another by a hinge-like structure, in particular are sewn together, and can be kept closed by a closing device, in particular a zipper;
- a positioning element to ensure that the musical instrument is correctly positioned within the case; and
- a fixation device to keep the musical instrument releasably in place within the case in cooperation with the positioning element.

2. Description of the Prior Art

In conventional cases for musical instruments, in particular guitars, not only the body of the instrument but also its neck and head are directly apposed to the inner surface of the case. shell. As a result, impacts to which the case is exposed, for example when it is set down or during transport, are transmitted practically unattenuated to these parts of the instrument. In particular for the sensitive instrument head, comprising mechanical apparatus for tuning the strings, this presents the risk of damage.

The patent DE 201 14 494 U1 discloses a bag for a musical instrument, in particular a guitar, in which the position of the instrument within the bag is fixed inasmuch as the neck of the instrument is kept a specified distance away from the wall of the bag. This is achieved by an element that can be releasably fixed to the bag and partially encloses the neck of the instrument. The releasable fixation is implemented, for instance, by a Velcro® fastening between element and bag. So that the element can retain the instrument neck, retaining straps are provided on the element. The element. itself consists of a foam material. In addition, a pocket to contain accessories is attached to the element.

A disadvantage of this musical-instrument bag disclosed in DE 201 14 494 U1 is that the element provided to keep the instrument neck spaced away from the container walruses up a considerable amount of space in the bag, reducing the volume available for things that need to be transported.

The object of the present invention is a case for musical instruments in which the neck and head of the instrument are spaced apart from the inner surface of the bag, so that the capacity of the bag can be utilized more effectively, e.g. to store additional objects.

SUMMARY OF THE INVENTION

This object is achieved in accordance with the invention by providing a case for musical instruments in which the musical instrument positioning element consists substantially of a pocket-like structure. According to the invention, the positioning element comprises an accessible cavity that accounts for most of the volume occupied by the positioning element and that is suitable for storing additional objects such as accessories for the instrument. As a result, the space available within the musical-instrument case is more effectively utilized.

The neck of the instrument, and/or its head, is kept away from the inner surface of the case by a distance determined by the height of the positioning element above the point at which it is attached to said inner surface. This height can be made such that the instrument neck and/or head are/is substantially equidistant from all the inner walls of the case. Preferably the height of the positioning element is between 3 and 7 cm.

The musical-instrument case itself consists of a floor section and a lid section. The floor section is the side of the case that contacts a substrate, e.g. a floor, when the case is set onto that substrate in the prescribed manner. The lid section is on the side of the case opposite the floor section.

In a preferred embodiment of the invention the positioning element is disposed on the floor section of the case. As a result, when the case has been placed on a substrate in the prescribed manner and is then opened, the instrument it contains remains in position when the lid section is open. It cannot fall out or slide out of place and thereby be damaged.

In a further development the pocket of which the positioning element mainly consists occupies substantially the entire volume enclosed by the surface of the positioning element.

In a specific embodiment the positioning element comprises a slitlike opening on one side. This arrangement makes the cavity in the interior accessible, so that the interior forms a pocket in which, for instance, -accessories such as cables or replacement items such as a spare -guitar strap can be stored.

In an advantageous embodiment the positioning element consists of a lower and an upper part. The lower part is on the side of the positioning element that contacts the place where the positioning element is attached to the -inside of the case. The upper part is on the side of the positioning element opposite the lower part. This upper part and this lower part of the positioning element are connected to one another in a hinge-like manner, in particular are sewn together, and can be closed together by a fastening device such as a zipper. Thus they form the pocket of which the positioning element substantially consists.

In a specific embodiment of the invention this pocket has a substantially rectangular shape. In this case the upper and lower parts of the positioning element can be hinged, in particular sewn together along one of the two short sides of the rectangular pocket or along one of its two long sides. On the other sides in either case they can be connected to one another by a zipper. Preferably this zipper connection extends continuously over all three of the remaining sides. This allows the pocket to be opened completely, so that its interior is readily accessible by raising the upper part.

An advantageous further development provides that on the free surface of the positioning element, which faces away from the associated floor or lid section, to achieve lateral fixation of the musical instrument at least two elongated auxiliary elements are attached, separated from one another by at least one crevice-like intermediate region. The width of this crevice-like intermediate region between the auxiliary elements should be between 0.5 cm and 4 cm, preferably between 1.0 cm and 2.5 cm. It is advantageous for the elongated auxiliary elements, and hence also the crevice-like intermediate region or regions between them, to be oriented parallel to the longer side of the rectangular pocket of the positioning element.

In an alternative embodiment, for the purpose of lateral fixation of the musical instrument a rectangular auxiliary element with at least one continuous crevice-like depression is attached to the positioning element on its free side, facing away from the associated floor or lid section. The width of this depression should be between 0.5 cm and 4 cm, preferably between 1.0 cm and 2.5 cm, and its depth should be between 1 cm and 3 cm, preferably about 2.0 cm. The at least one crevice-like depression is advantageously oriented parallel to the longer side of the rectangular pocket of the positioning element.

Both the crevice-like intermediate region between the elongated auxiliary elements and the crevice-like depression in a rectangular auxiliary element enable an instrument neck disposed therein to be partially enclosed and fixed so as to avoid lateral displacement.

In a specific advantageous embodiment the auxiliary element consists, or the auxiliary elements consist, at least in part, of a cushioning substance, in particular a foam material.

A further development provides that the height of the auxiliary element or elements above the positioning element is substantially the same over the entire length of the auxiliary element(s). Here the term "length" should be understood to mean the extent of the auxiliary element parallel to its long axis. The height should be between 2 cm and 6 cm, preferably between 3 cm and 5 cm.

An alternative further development provides that the height of the auxiliary element or elements above the positioning element increases along the long axis of the auxiliary element(s), in particular from about 3 cm to about 5 cm. This feature achieves a better match to the specific shape of the instrument, i.e. in particular to the structure of the neck of a string instrument.

In another specific embodiment the maximal height of the auxiliary element or elements above the positioning element is less than the height of the positioning element above the site at which the latter is attached to the inner surface of the case.

The auxiliary elements are preferably so dimensioned and arranged that substantially the entire width of the positioning means is put to use. The length of the auxiliary means can correspond to that of the positioning means, but can also be distinctly shorter.

In an advantageous embodiment of the invention one or more fixation bands are provided as means of fixation, in particular are attached below the positioning element in such a way that their attachment is independent of the attachment of the positioning element to the case. These fixation bands can advantageously be connected to one another at their free ends by way of releasable connecting means, in particular Velcro elements.

These bands do not only allow the instrument to be fixed in the desired position on the positioning means; in addition, when the fixation bands are attached to the case independently of the actual attachment of the positioning element, an instrument can be securely fixed within the case even without any positioning means. Furthermore, if the positioning means were to become detached from the case, the fixation device would keep both instrument and positioning means securely within the case.

In a specific embodiment the auxiliary means are covered by a textile material, in particular a thick, soft fabric.

It can also be provided that the positioning element consists substantially of textile material, which in particular is identical to the material of which the covering of the auxiliary means consists. For example, a thick, soft fabric can be used for this purpose. The seams can be enclosed in a resistant textile material. The same applies to the edges of the material along which is attached the zipper that connects the upper and lower parts of the positioning element to one another.

The musical-instrument case itself can be constructed as a flexible bag or sheath or as a substantially rigid container.

BRIEF DESCRIPTION OF THE DRAWINGS

The invention both as to its construction and its mode of operation, together with additional advantages and objects thereof, will be best understood from the following detailed description of preferred embodiments, when read with reference to the accompanying drawings, wherein.

DETAILED DESCRIPTION OF THE PREFERRED EMBODIMENTS

Figure 1:
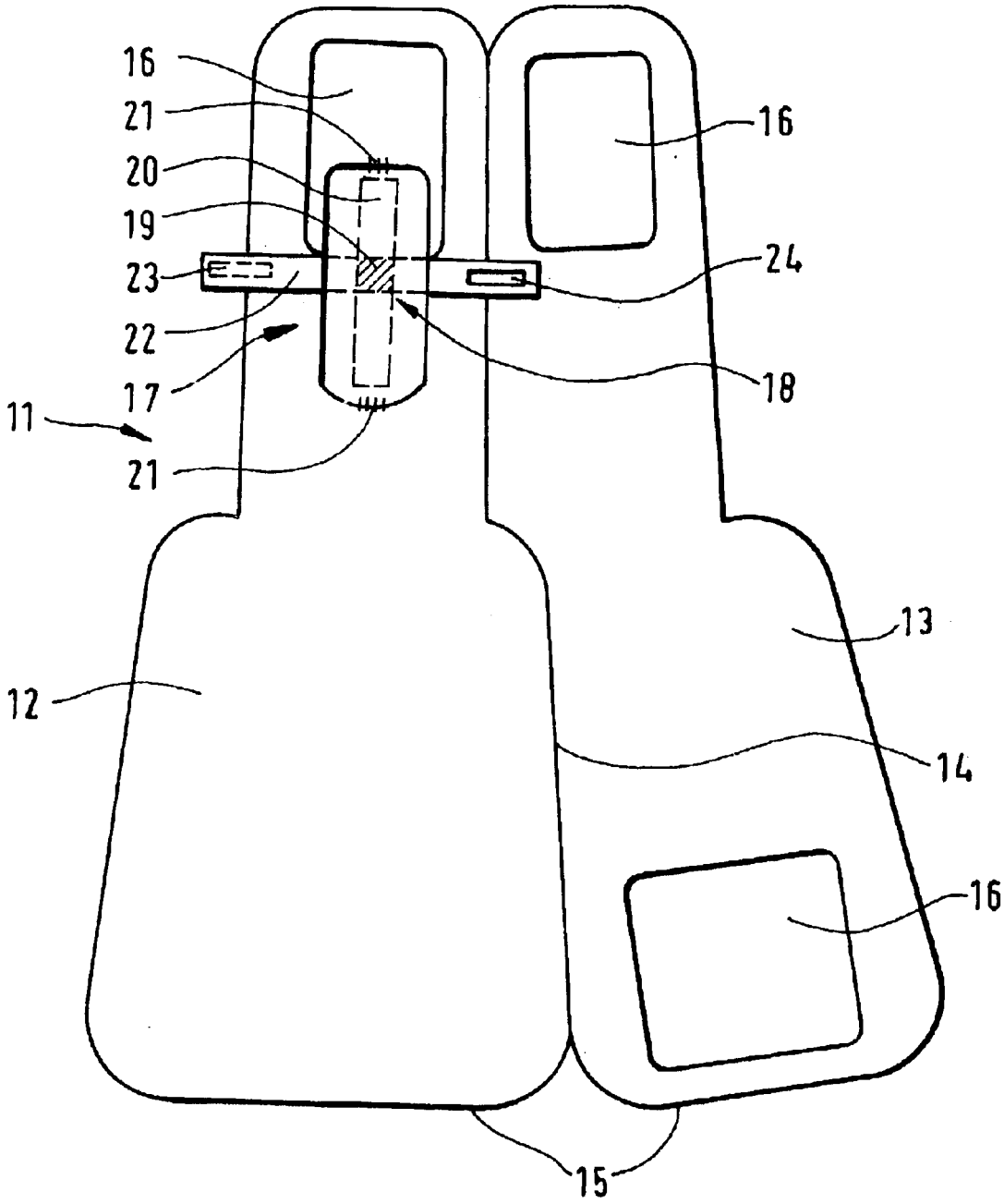
FIG. 1 shows a diagram showing the arrangement of the positioning element in an opened guitar case.

FIG. 1 shows in principle the arrangement of a positioning element 17 in accordance with the invention within a guitar case 11. The guitar case 11 is shown as it appears when opened; its external shape is matched to the outer contours of a guitar. A comparable arrangement can be achieved analogously in other flexible or rigid cases for other musical instruments, such as bass guitars or violins.

The guitar case comprises a floor section 12 and a lid section 13, connected to one another by way of a hinge-like connection 14, for instance a sewn seam. The guitar case 11 can be closed by means of a fastening device 15, for instance a zipper, disposed between floor section 12 and lid section 13. In the region of the guitar case 11 in which the head of the guitar is to be disposed, leather pads 16 are attached to the floor section 12 and lid section 13. Another leather pad 16 is attached to the lid section 13 in the region where the body of the guitar is to be disposed.

The positioning element 17 is disposed in the interior of the guitar case 11, in the same region thereof in which the neck of the guitar is placed. The positioning element 17 is attached to the floor section 12 by means of sewn connections 21. As an alternative to a connection produced by sewing, or in addition thereto, the positioning element 17 can be attached to the floor section 12 by means of Velcro strips 18. This variant is also shown in FIG. 1. For this purpose a first Velcro strip 19 (cross-hatched in FIG. 1) is mounted on the floor section 12. The Velcro strip 20 that complements the strip 19 is mounted on the side of the positioning element 17 that faces the floor section 12. In FIG. 1 the elements underneath the positioning element 17 are indicated by the dashed outline.

Attachment by sewn connections 21 ensures that the positioning element 17 is firmly attached to the guitar case 11. When a Velcro fastening 18 is additionally provided, it ensures that the middle region of the positioning element 17 cannot be displaced with respect to the floor section 12 of the guitar case 11, whatever the orientation of the guitar case 11 may be during transport and storage. For example, even if the guitar case 11 is turned upside down, i.e. so that the floor section 12 faces upward, the middle part of the positioning element cannot "hang down" into the case.

Also visible in FIG. 1 is the fixation band 22, provided to be bent around the neck of the guitar and thereby fix it in position. This band is attached to the floor section 12 below the first Velcro strip 19 and the positioning element 17. At the two free ends of the fixation band 22 two complementary Velcro elements 23, 24 are disposed. The Velcro connection formed by these elements 23, 24 when the band is bent around the neck of the guitar ensures that the latter is securely retained. The fixation band 22 could also be mounted on the positioning element 17 (not shown). The advantage of attaching the fixation band 22 to the floor section 12 resides in the fact that even if the positioning element should become detached from the floor section 12, the fixation band 22 would still reliably keep the neck of the guitar in place.

Figure 2:
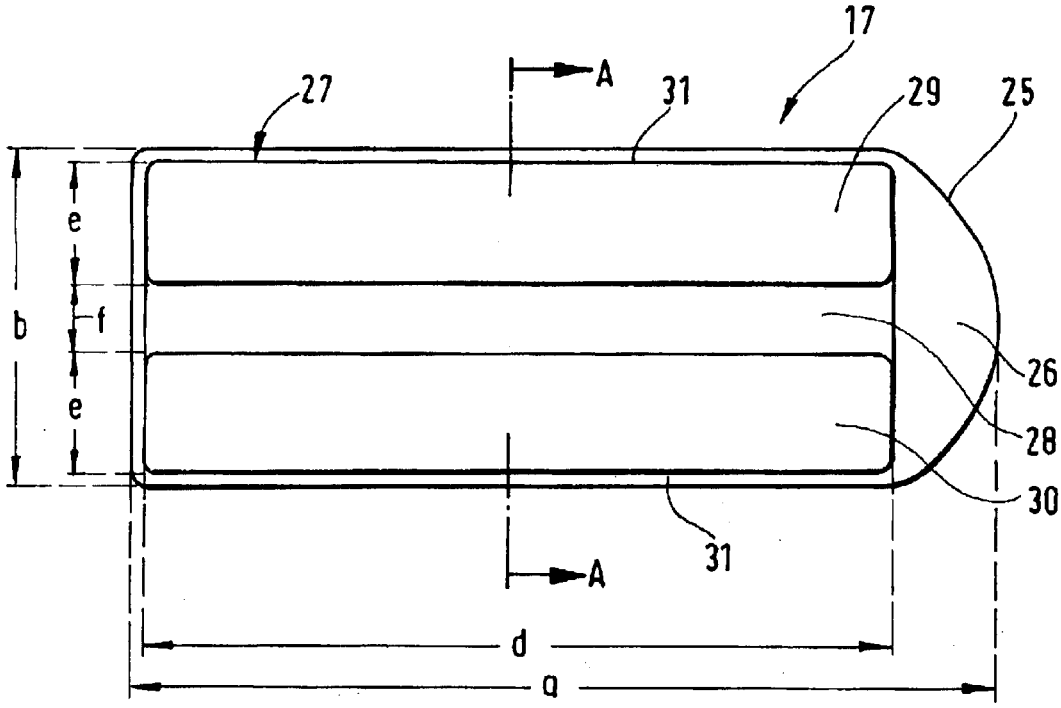
FIG. 2 shows a plan view of a positioning element.

FIG. 2 shows an embodiment of the positioning element 17 in 10 plan view, so that the pocket 25 of the positioning element 17 is visible. Disposed on the upper part 26 of the positioning element 17 is a rectangular auxiliary element 27 with a crevice-like depression 28 oriented along its midline, parallel to the long side 31 of the rectangular auxiliary element 27 and extending over the entire length thereof. Other features that can be seen here are the first raised section 29 and second raised section 30 of the auxiliary element 27, between which is the crevice-like depression 28.

Figure 3:
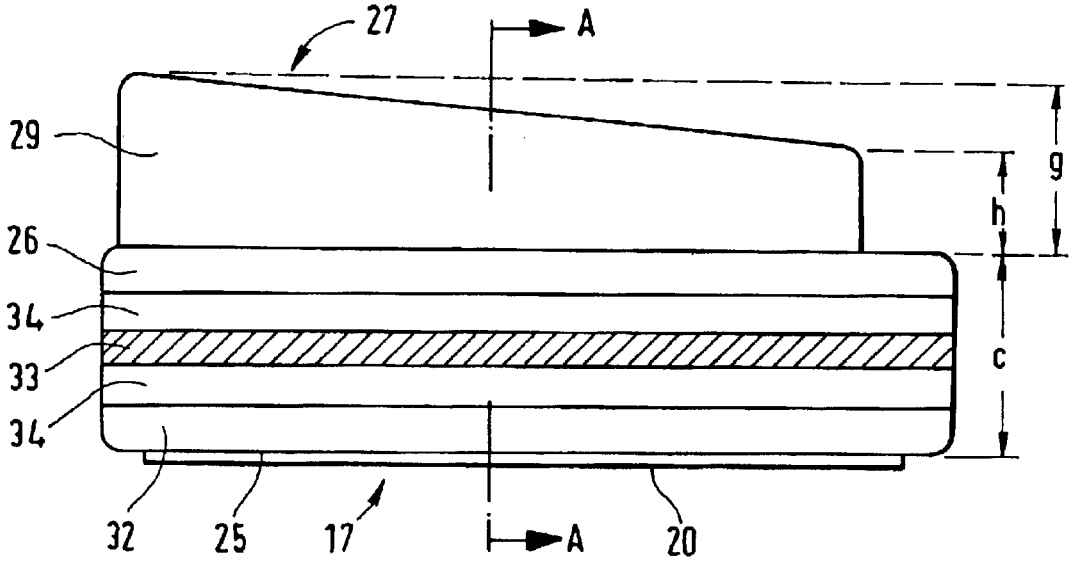
FIG. 3 shows the side view of the positioning element shown in FIG. 2.

FIG. 3 shows the positioning element 17 according to FIG. 2 in a side view, such that the first raised section 29 of the rectangular auxiliary element 27 is visible. The height of this first raised section 29 decreases from left to right in FIG. 3. The second raised section 30 (not visible) of the auxiliary element 27 has an identical configuration. It can also be seen that the positioning element 17 is constructed as a pocket 25 consisting of an upper part 26 and a lower part 32. The upper part 26 and lower part 32 of the positioning element 17 are connected to one another by a zipper 33. This zip fastener extends over the long side of the positioning element 17 shown here and continues along the first narrow side thereof, which is adjacent on the right in FIG. 3, and along the second long side, which is opposite the long side visible in the drawing. At the second narrow side of the positioning element 17, the upper part 26 and lower part 32 of the positioning element 17 are sewn together (not shown). In FIG. 3 the zipper 33 is disposed in the middle of the sides of the positioning element 17. However, it can also be off-center; i.e. displaced toward the upper part 26 or lower part 32 of the positioning element 17 (not shown).

FIG. 3 also shows that the edges of the upper part 26 and lower part 32 of the positioning element 17 that are directed toward the zipper 33 are enclosed by a binding. The bindings along these edges are identified by the numeral 34. It is to the inside of these bindings 34 that the zipper 33 is attached (see FIG. 4). On the lower side of the positioning element 17 can be seen the second Velcro strip 20, provided for fixation of the positioning element 17 to the floor section 12 of the guitar case 11.

In FIGS. 2 and 3 the dimensions of the illustrated positioning element 17 and the associated auxiliary element 27 are indicated. The length of the positioning element 17 is represented by a, its width by b, and its height by c. The length of the auxiliary element 27 is represented by d, and the width of each of the two matching elevations, namely the first raised section 29 and the second raised section 30, is represented by e. The letter f designates the width of the crevice-like depression 28 of the auxiliary element 27. The larger height of the auxiliary element 27 (on the left in FIG. 3) is indicated by g, and its smaller height (on the right in FIG. 3), by h.

In a specific embodiment these dimensions are approximately as follows:

a=26 cm
b=10 cm
c=6 cm
d=22 cm
e=4 cm
f=2 cm
g=5 cm
h=3 cm

Figure 4:
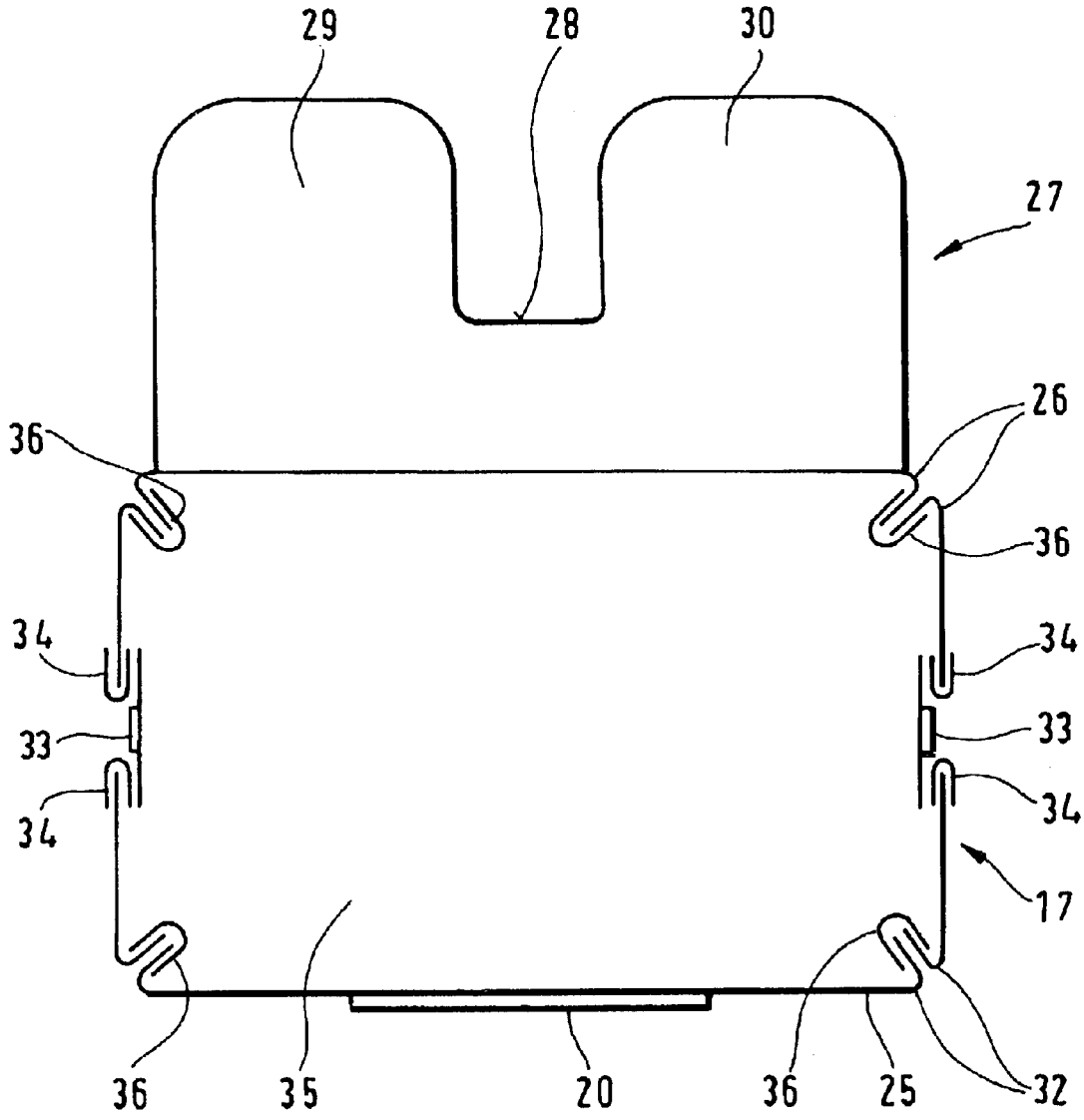
FIG. 4 shows a section along the line A—A in FIG. 2 and FIG. 3.

FIG. 4 shows a section along the lines A—A in FIGS. 2 and 3. This aspect makes visible the cavity 35 within the pocket 25 of which the positioning element 17 substantially consists. The zipper 33 is attached to the inside of the positioning element 17 along the bindings 24 that enclose the edges of the upper part 26 and lower part 32 of the positioning element 17. Upper part 26 and lower part 32 in the illustrated embodiment are composed of several elements that are sewn together. The seams are turned into the cavity 35 of the pocket 25, and are enclosed by bindings 36. To the upper part 26 of the positioning element 17 the auxiliary element 27 is attached. Visible here are the first raised section 29 and the second raised section 30, as well as the crevice-like depression 28. On the lower side of the positioning element 17 the second Velcro strip 20, used to attach the positioning element 17 to the floor section 12 of the guitar case 11, can be seen.

Figure 5:
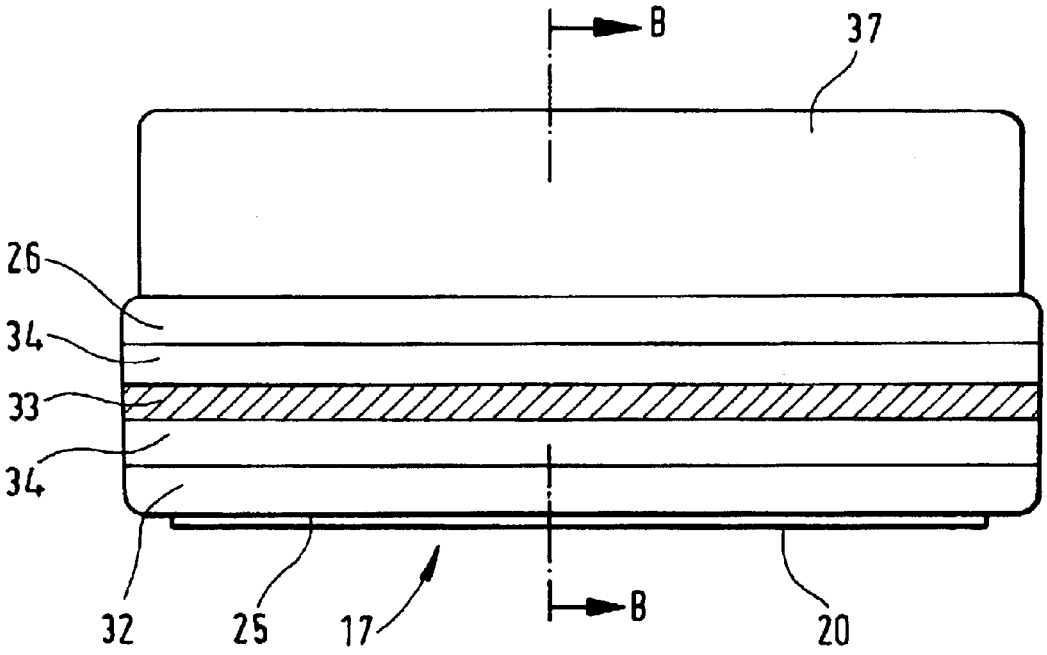
FIG. 5 shows another embodiment of an auxiliary element.
Figure 6:
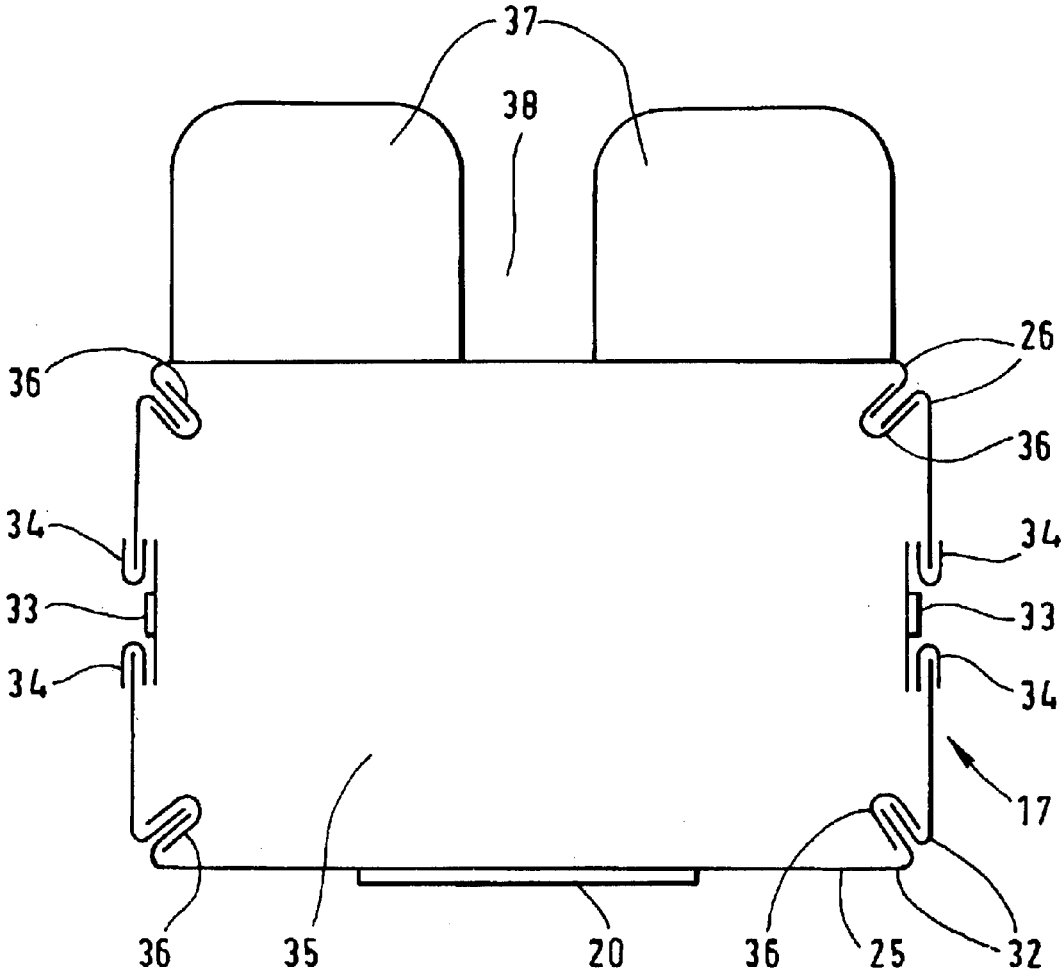
FIG. 6 shows a section along the line B—B in FIG. 5.

In FIG. 5 is shown a positioning element 17 identical to the positioning element 17 illustrated in FIG. 3; however, the auxiliary element 37 attached to this positioning element is differently constructed. That is, the height of the present auxiliary element 37 is the same over its entire length. The detailed structure of this auxiliary element can be seen in FIG. 6, a sectional drawing along the line B—B in FIG. 5. In the exemplary embodiment represented here, two identical elongated auxiliary elements 37 are disposed on the upper part 26 of the positioning element 17, between which there is a crevice-like intermediate region 38.

Figure 7:
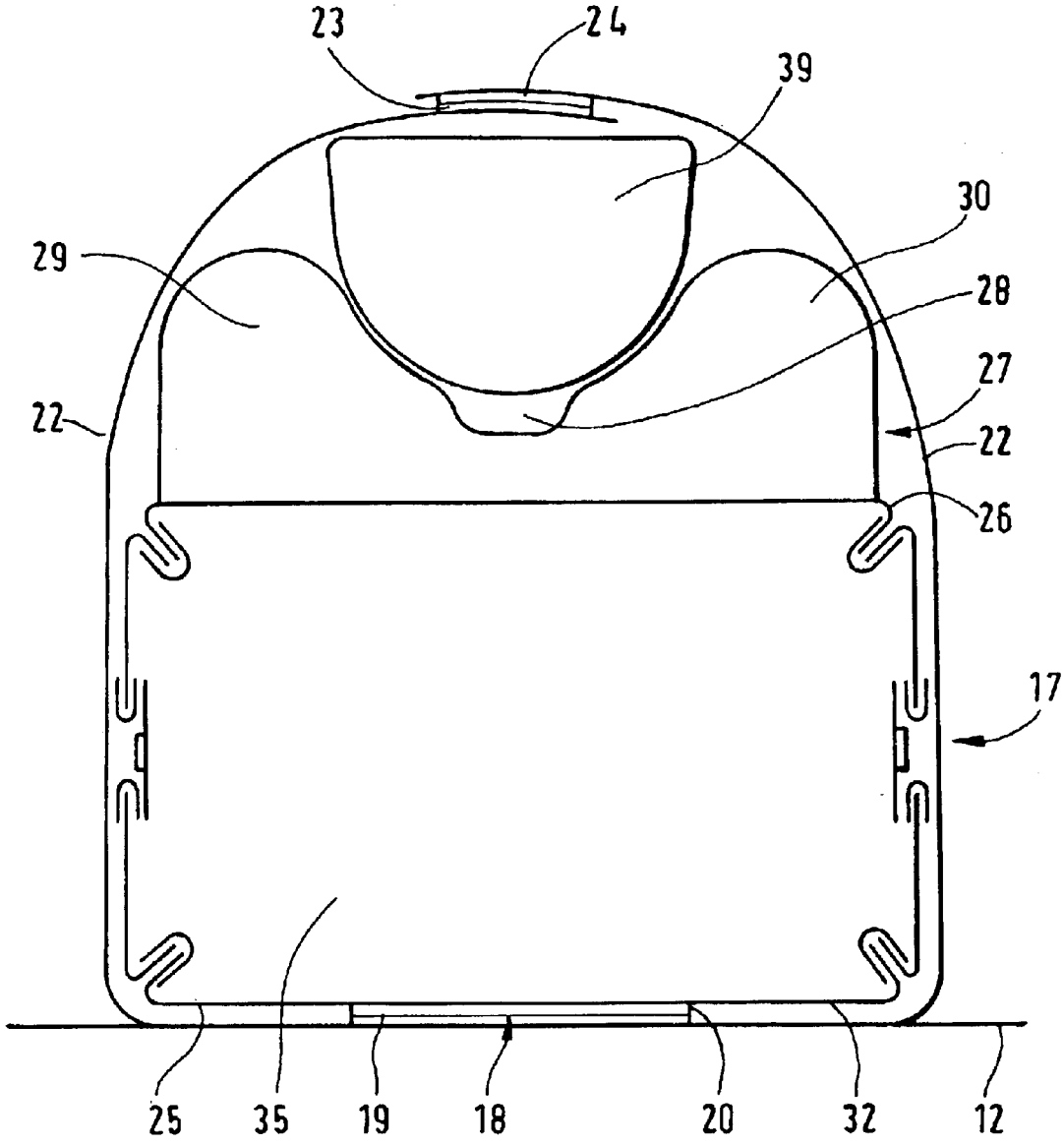
FIG. 7 shows a sectional drawing of a positioning element according to FIG. 4, additionally showing the neck of a guitar that has been placed on the positioning element and is held there by a fixation band.

FIG. 7 is a sectional drawing of the positioning element 17 with attached auxiliary element 27 as shown in FIG. 4, except that in FIG. 7 a guitar neck 39 has been placed against the positioning element 17 and is being held there by means of a fixation band 22. The fixation band 22 is attached to the floor section 12 of the guitar case 11. On the fixation band 22 is mounted the first Velcro strip 19, which is used to hold the positioning element 17 against the floor section 12. The second Velcro strip 20, which cooperates with the first strip 19, is 5 attached to the lower part 32 of the positioning element 17. The auxiliary element 27 disposed on the upper part 26 of the positioning element 17 is made of an elastic substance, such as a foam material. Hence a deformation of the auxiliary element 27, in particular the first raised section 29 and the second raised section 30, occurs when the guitar neck 39 is placed in the crevice-like depression 28. The auxiliary element 27 therefore partially encloses the guitar neck 39, thus ensuring lateral fixation of the neck 39. Complete fixation of the guitar neck 39 is achieved by closing the Velcro elements 23 and 24, which are mounted on the free ends of the fixation band 22.

The fixation band 22 is thus pulled tight against the outer sides of positioning element 17 and auxiliary element 27, and is closed above the guitar neck 39.

FIG. 7 again shows the cavity 35 in the pocket 25 of the positioning element 17. Within this cavity 35 various objects such as accessories can be stored (not shown). Depending on various factors—the material of which the positioning element is made, and/or the degree of filling of the cavity 35 in the pocket 25, and/or the pressing force exerted by the fixation band 22—the positioning element 17, as shown in FIG. 7, can substantially preserve its external shape when the guitar neck 39 has been set onto it, or can be distinctly deformed thereby, in particular can be compressed in the direction of the floor section 12. Shape stability can also be achieved, i.e. compression can be prevented, by the provision of stiffening elements (not shown) disposed against the side surfaces of the positioning element 17, at which the upper part 26 and lower part 32 of the positioning element 17 are connected to one another, and/or on the side of the positioning element 17 that faces away from the associated floor section 12 or lid section 13.

A feature not shown in the figures is that the auxiliary element(s) 27, 37 can be covered by a 'textile material. Also not illustrated is the fact that because of the zipper 33, which is disposed so that it passes continuously along three sides of the positioning element 17, the pocket 25 of the positioning element 17 can be completely opened by folding up the upper part 26 of the positioning element 17. As a result, the cavity 35 in the pocket 25 of the positioning element 17 can be filled and emptied again in a simple manner.

What is claimed is:

1. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the hinge connection is formed as a sewn seam, and wherein the fastening means (15) is formed as a zipper.

2. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the pocket (25) extends substantially over an entire volume of the positioning element (17) contained within a surface of the positioning element (17).

3. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the positioning element (17) comprises a lower part (32) and an upper part (26) joined to one another by a hinge connection, and a fastening element (33) arranged between the lower and upper parts for closing the positioning element.

4. A case according to claim 3, wherein the hinge connection is formed a sewn seam, and wherein the fastening element (33) is formed as a zipper.

5. A case according to claim 3, wherein the pocket (25) has a substantially rectangular shape which is defined by the lower part (32) and the upper part (26), the lower and upper parts (32, 26) being joined to one another along one of one of two narrow sides and one of two long sides of the substantially rectangular pocket.

6. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the positioning element (17) has at least two elongate auxiliary elements (37) attached to a free surface of the positioning element (17) for lateral fixation of the string instrument, and at least one substantially crevice-shaped intermediate region (38) provided between the at least two auxiliary elements (37) and having a width between 0.5 cm and 4 cm.

7. A case according to claim 6, wherein the width of the substantially crevice-shaped intermediate region is between 1 cm and 2.5 cm.

8. A case according to claim 6, wherein a height of the auxiliary element (37) above the positioning element (17) is substantially the same over an entire length of the auxiliary element (37) and is between 2 cm and 6 cm.

9. A case according to claim 8, wherein the height of the auxiliary element (37) is between 3 cm and 5 cm.

10. A case according to claim 6, wherein a height (g, h) of the auxiliary element (37) above the positioning element (17) increases along a length of the auxiliary element (37) from about 3 cm to about 5 cm.

11. A case according to claim 6, wherein a maximal height (g) of the auxiliary element (37) above the positioning element (17) is smaller than a height (c) of the positioning element (17).

12. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the positioning element (17) has a rectangular auxiliary element (27) disposed on a free surface of the positioning element (17) for lateral fixation of the string instrument, and at least one continuous substantially crevice-shaped depression (28) associated with the auxiliary element (27) and having at least one of a width between 0.5 cm and 4 cm and a depth between 1 cm and 3 cm.

13. A case according to claim 12, wherein the substantially crevice-shaped depression (28) has the at least one of the width between 1.0 cm and 2.5 cm and the depth of about 2 cm.

14. A case according to claim 12, wherein a height of the auxiliary element (27) above the positioning element (17) is substantially the same over an entire length of the auxiliary element (27) and is between 2 cm and 6 cm.

15. A case according to claim 14, wherein the height of the auxiliary element (27) is between 3 cm and 5 cm.

16. A case according to claim 12, wherein a height of the auxiliary element (27) above the positioning element (17) is substantially the same over an entire length of the auxiliary element (27) and is between 2 cm and 6 cm.

17. A case according to claim 12, wherein a height (g, h) of the auxiliary element (27) above the positioning element (17) increases along a length of the auxiliary element (27) from about 3 cm to about 5 cm.

18. A case for string instruments, comprising:

a floor section (12);

a lid section (13) joined to the floor section (12) by a hinge connection;

fastening means (15) arranged between the floor and lid sections for closing the case;

a positioning element (17) for positioning a string instrument in the case and having a pocket (25) for storing additional objects in the case and coverable by the string instrument; and a fixation device (22) for releasably fixing the string instrument that is supported on the positioning element, wherein the fixation device (22) comprises at least one fixation band attached to the case (11) below the positioning element (17) and independent of the positioning element (17).

* * * * *